US010634343B2

(12) United States Patent
Yang

(10) Patent No.: US 10,634,343 B2
(45) Date of Patent: Apr. 28, 2020

(54) HIGH-TEMPERATURE PYROLYSIS INCINERATION APPARATUS

(71) Applicant: Bok Joo Yang, Gyeonggi-do (KR)

(72) Inventor: Bok Joo Yang, Gyeonggi-do (KR)

(73) Assignee: Shinpoong Co., Ltd., Seoul (KR)

( * ) Notice: Subject to any disclaimer, the term of this patent is extended or adjusted under 35 U.S.C. 154(b) by 120 days.

(21) Appl. No.: 15/744,188

(22) PCT Filed: Jun. 16, 2016

(86) PCT No.: PCT/KR2016/006414
§ 371 (c)(1),
(2) Date: Jan. 12, 2018

(87) PCT Pub. No.: WO2017/010691
PCT Pub. Date: Jan. 19, 2017

(65) Prior Publication Data

US 2018/0202656 A1 Jul. 19, 2018

(30) Foreign Application Priority Data

Jul. 16, 2015 (KR) ..... 10-2015-0101151

(51) Int. Cl.
*F23G 5/027* (2006.01)
*F23G 5/46* (2006.01)
(Continued)

(52) U.S. Cl.
CPC ..... *F23G 5/027* (2013.01); *F23G 5/008* (2013.01); *F23G 5/0276* (2013.01); *F23G 5/14* (2013.01);
(Continued)

(58) Field of Classification Search
CPC ..... F23G 5/027
See application file for complete search history.

(56) References Cited

U.S. PATENT DOCUMENTS

| | | | | |
|---|---|---|---|---|
| 4,583,469 | A | 4/1986 | DiSabatino | |
| 5,291,840 | A | 3/1994 | Nakao | |
| 9,657,941 | B2 * | 5/2017 | Tsantrizos | F23G 5/027 |
| 2005/0039649 | A1 * | 2/2005 | Song | F23G 5/165 110/235 |
| 2009/0071382 | A1 * | 3/2009 | Clarke | F23G 5/027 110/346 |

(Continued)

FOREIGN PATENT DOCUMENTS

| | | |
|---|---|---|
| CN | 86102025 A | 12/1986 |
| CN | 101135453 A | 3/2008 |

(Continued)

OTHER PUBLICATIONS

European Search Report for Application No. 16824608.0-1008/3324117 dated Mar. 1, 2019.
Search Report for PCT/KR2016/006414, dated Sep. 27, 2016.

*Primary Examiner* — Nathaniel Herzfeld
(74) *Attorney, Agent, or Firm* — Dinsmore & Shohl LLP

(57) ABSTRACT

A high-temperature pyrolysis incineration apparatus that forces external air to a combustion chamber while burning an incineration processing material injected therein at a high temperature within a combustion chamber is provided. The apparatus includes an air-supply tube disposed at the center of the combustion chamber, a fuel supply pipe installed at an upper edge of the inside of the combustion chamber, a punching plate disposed at the bottom of the combustion chamber, a stirring rod rotatably installed at an upper surface of the punching plate using the air-supply tube as a fixing shaft, a heat recovery device disposed outside of the combustion chamber, and a circulation pipe extending from a lid of the combustion chamber to the outside that returns to a location corresponding to an upper portion of the stirring rod at a wall of the combustion chamber via the inside of the heat recovery device.

4 Claims, 7 Drawing Sheets

(51) Int. Cl.

| | |
|---|---|
| ***F23G 5/00*** | (2006.01) |
| ***F23G 7/05*** | (2006.01) |
| ***F23N 5/02*** | (2006.01) |
| ***F23N 1/00*** | (2006.01) |
| ***F23G 5/14*** | (2006.01) |
| ***F23G 5/24*** | (2006.01) |

(52) U.S. Cl.

CPC ..... *F23G 5/24* (2013.01); *F23G 5/245* (2013.01); *F23G 5/46* (2013.01); *F23G 7/05* (2013.01); *F23N 1/002* (2013.01); *F23N 1/005* (2013.01); *F23N 5/022* (2013.01); *F23G 2201/303* (2013.01); *F23G 2201/304* (2013.01); *F23G 2202/105* (2013.01); *F23G 2202/106* (2013.01); *F23G 2206/00* (2013.01); *F23G 2900/00001* (2013.01); *F23G 2900/50007* (2013.01); *F23G 2900/55* (2013.01); *F23N 2025/08* (2013.01)

(56) References Cited

U.S. PATENT DOCUMENTS

2010/0031571 A1* 2/2010 Ershag ..... C10B 1/04
48/123

FOREIGN PATENT DOCUMENTS

| | | | |
|---|---|---|---|
| CN | 201067677 | Y | 6/2008 |
| EP | 1221573 | A1 | 7/2002 |
| EP | 1227163 | A2 | 7/2002 |
| GB | 468887 | A | 7/1937 |
| JP | S59212616 | A | 12/1984 |
| JP | H0545423 | | 6/1993 |
| JP | H7332646 | A | 12/1995 |
| JP | H9217909 | A | 8/1997 |
| JP | 4916268 | | 4/2012 |
| KR | 200390978 | Y1 | 7/2005 |
| KR | 10-2007-0041127 | A | 4/2007 |
| KR | 10-1055854 | B1 | 8/2011 |

* cited by examiner

HIGH-TEMPERATURE PYROLYSIS INCINERATION APPARATUS

CROSS-REFERENCE TO RELATED APPLICATIONS

This application is the U.S. national stage of PCT/KR2016/006414 filed Jun. 16, 2016, which claims priority of Korean Patent Application No. 10-2015-0101151 filed Jul. 16, 2015.

TECHNICAL FIELD

The present invention relates to an incineration apparatus. More particularly, the present invention relates to a high-temperature pyrolysis incineration apparatus that incinerates general household waste or industrial waste at a high temperature.

BACKGROUND

Several methods of waste processing occurring in human society have been researched and developed, but most waste has been processed with a method of landfill, ocean dumping, or incineration.

Here, an incineration method is generally performed with a method of burning waste that is collected and carried from each place together with fuel with large scale equipment, and dumping resulting ash. However, an initial equipment cost of such a large incineration facility is enormous and a great deal of operation management cost is required, and a collection and transport problem and a processing problem of the remaining ash after incineration additionally occur.

As a method of solving such a problem, a small-scale industrial waste processing apparatus that can be moveably installed has been in the spotlight, and particularly, a low-temperature pyrolysis incineration apparatus that is developed as a result of research on processing of special waste in which incineration processing should be performed, such as medical waste and industrial waste, is put to practical use.

Next, Korean Utility Model Registration No. 20-0256297 is an example of the above-described low-temperature pyrolysis incineration apparatus, and discloses a low-temperature pyrolysis apparatus of a combustible gas using industrial waste as a main fuel.

The low-temperature pyrolysis incineration apparatus vaporizes a carbon material of industrial waste by pyrolyzing various waste tires or industrial waste at a low temperature in a main body of a carbonization device, and completely burns the industrial waste by supplying a gas to a combustion chamber through an induction pipe while continuously generating a gas that can use as a fuel, thereby processing without discharge of an air pollution material.

However, a low-temperature pyrolysis incineration apparatus of the above-described configuration has a drawback that an exhaust gas heavily occurs while a combustion chamber is often overheated when burning a chemical product such as vinyl and plastic, and because waste having a high moisture content is incompletely burned, the waste having a high moisture content should be burned separately from waste in a dry state.

Particularly, only when a separate secondary combustion apparatus is installed at the exhaust side of the incineration apparatus is dioxin occurring while burning removed and thus energy waste increases, and an incineration time is extended by low-temperature pyrolysis, such that a limitation exists in a one-day processing capacity.

The present inventor has suggested an apparatus that can pyrolyze at a high temperature as an incineration apparatus that solves the problem.

Next, Korean Patent No. 10-1483751 relates to a high-temperature pyrolysis incineration apparatus that is suggested by the present inventor and that is registered as a patent, and because the high-temperature pyrolysis incineration apparatus has a configuration of injecting an incineration material into an internal combustion chamber, starting combustion in a closed and sealed state to be isolated from the outside, and performing high temperature combustion while forcibly supplying outside air upon combustion, the high-temperature pyrolysis incineration apparatus may incinerate an incineration material by complete combustion in a high temperature state.

The high-temperature pyrolysis incineration apparatus is small scale equipment that can be easily moved and that burns an incineration material at a high temperature by forcedly injecting air necessary for combustion to a space that is separated from the outside, and the high-temperature pyrolysis incineration apparatus has a merit that it can completely burn general household waste or industrial waste, but because the high-temperature pyrolysis incineration apparatus has a structure in which a blast pipe is disposed along an interior circumference of a combustion chamber, an area of the combustion chamber is relatively small and thus the high-temperature pyrolysis incineration apparatus has a small processing capacity, compared with an external form size.

By embedding a heat exchange pipe within a wall body of the combustion chamber, the high-temperature pyrolysis incineration apparatus has a structure that recovers heat of hot air or hot water to be discarded, and thus a wall of the combustion chamber has a large thickness and a heavy weight.

SUMMARY

The present invention has been made in an effort to provide a high-temperature pyrolysis incineration apparatus that is improved into a configuration that minimizes encroachment of an internal area of a combustion chamber due to installation of a blast pipe in order to solve a structural problem of a high-temperature pyrolysis incineration apparatus of Korean Patent No. 10-1483751 that is suggested by the present applicant, reducing a wall thickness by improving recovery of waste heat that is normally discarded through a lid of the combustion chamber, and completely burning an incineration material without a non-combustion residue in a short time.

An exemplary embodiment of the present invention provides a high-temperature pyrolysis incineration apparatus that forcedly supplies external air to a combustion chamber while burning an incineration processing material that is injected therein at a high temperature within a combustion chamber that is isolated from the outside, wherein an air-supply tube is fixedly disposed at the center of the combustion chamber, a fuel supply pipe is installed at an upper edge of the inside of the combustion chamber, the bottom of a lower portion thereof is formed with a punching plate for discharging ash that is generated by combustion to the outside, a stirring rod rotating using the air-supply tube as a fixing shaft is disposed at the center of the bottom thereof, a heat recovery device is disposed at one side of the outside of the combustion chamber, and a circulation pipe is extended from one side of the lid of the combustion chamber to the outside to return to a location corresponding to an upper portion of the stirring rod at a wall of the combustion chamber via the inside of the heat recovery device.

Further, according to the present invention, at the inside of the stirring rod, a plurality of holes are provided to enable the stirring rod to have a light weight, and a contour of the upper and lower sides is formed in a wave shape, such that while stirring, an incineration processing material uniformly contacts air instead of being cornered to one side to be completely burned in a short time.

In addition, according to the present invention, by interposing a ball valve in a circulation pipe that is extended from a lid of an upper portion of the combustion chamber to a heat recovery device, when the lid is opened, a passage of the circulation pipe is automatically closed and thus external air does not enter into the heat recovery device.

Further, according to the present invention, as a controller controls an auxiliary fuel apparatus with an electric signal that is obtained by measuring an internal temperature of a combustion chamber with a temperature sensor, the internal temperature of the combustion chamber may not be lowered to 800° C. or less.

According to a high-temperature pyrolysis incineration apparatus that is suggested in the present invention, as an air-supply tube is disposed at the center of a combustion chamber, an area occupied by a combustion space is minimized and thus processing capacity becomes large, compared with an external form.

Air that is forcedly injected through a ventilation fan is ejected from an air-supply hole of three steps of a high portion, a middle portion, and a lower portion to the air-supply tube of the center of the combustion chamber, and a lower portion, and thus air necessary for combustion can be fully supplied to a corner of the combustion chamber.

Further, as a stirring rod continuously stirs an incineration processing material, the high-temperature pyrolysis incineration apparatus can completely burn the incineration processing material without a combustion residue.

In addition, a circulation pipe that is extended from one side of a lid to the outside circulates a combustion gas in which waste heat is recovered via the inside of a heat recovery device to return again to a lower portion of the combustion chamber and thus a thermal loss is minimized, whereby a waste heat recovery rate is excellent.

Because a hole is formed in an intermediate portion of a stirring rod, an incineration processing material is not cornered to one side while stirring and thus a stirring effect uniformly occurs over an entire combustion chamber.

Further, when opening a lid, a circulation pipe that is extended to a heat recovery device is automatically blocked and thus waste heat is not leaked from the heat recovery device to the inside of the lid, whereby an operator can safely reload an incineration processing material into a combustion chamber.

According to the present invention, when combustion is performed within a combustion chamber, if an internal temperature thereof is measured to be less than 800° C., a controller has a configuration for operating a pump of a fuel supply device and thus when burning an incineration processing material, an internal temperature of the combustion chamber is maintained at a temperature range in which dioxins do not occur and thus there is a merit that dioxins are not discharged into the air.

DETAILED DESCRIPTION OF PREFERRED EMBODIMENTS

Figure 1:
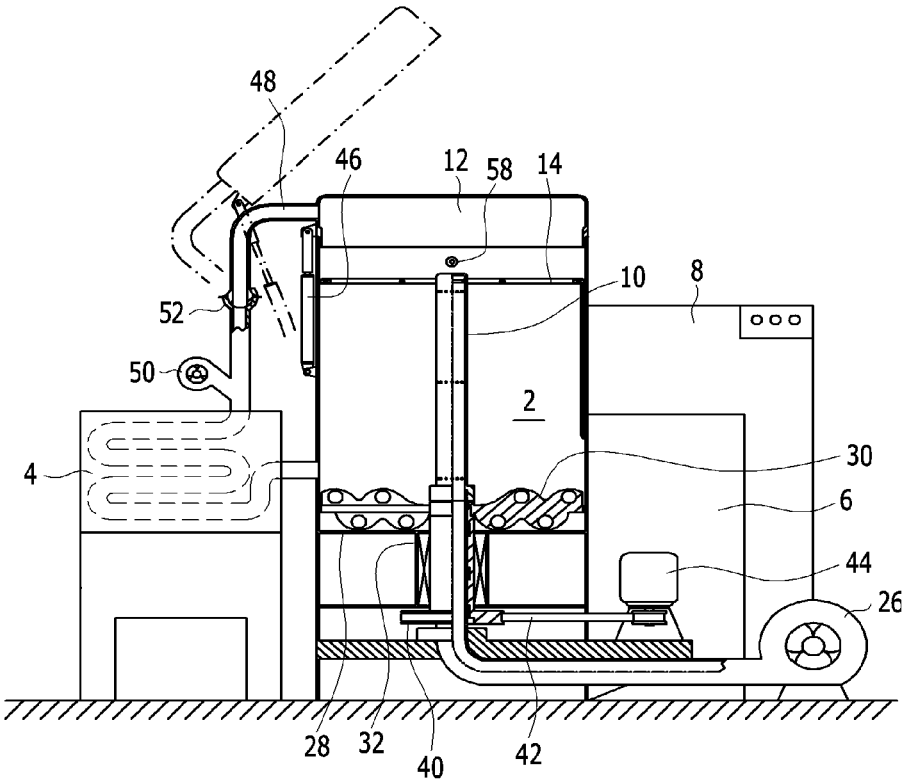
FIG. 1 is a side cross-sectional view of a high-temperature pyrolysis incineration apparatus according to an exemplary embodiment of the present invention.

Hereinafter, an exemplary embodiment of the present invention will be described in detail with reference to the accompanying drawings.

However, when describing an exemplary embodiment of the present invention in detail, like reference numerals designate like portions that perform similar functions and operations throughout the specification.

Throughout this specification and the claims that follow, when it is described that an element is "connected" to another element, the element may be "directly connected" to the other element or "indirectly connected" to the other element through a third element.

In addition, unless explicitly described to the contrary, the word "comprise" and variations such as "comprises" or "comprising" will be understood to imply the inclusion of stated elements but not the exclusion of any other elements.

Figure 2:
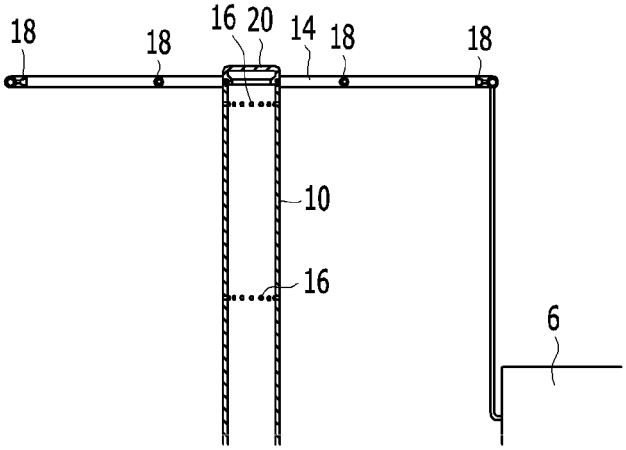
FIG. 2 is an enlarged view illustrating an air-supply tube that is disposed within a combustion chamber of FIG. 1 and a peripheral nozzle thereof.
Figure 3:
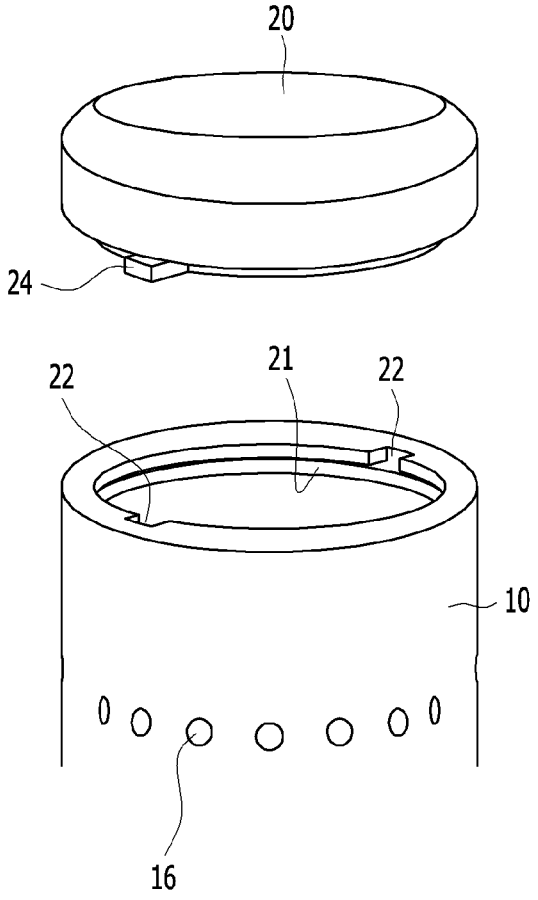
FIG. 3 is an exploded perspective view illustrating a coupling and mounting structure of a stopper of an upper end portion of an air-supply tube.
Figure 4:
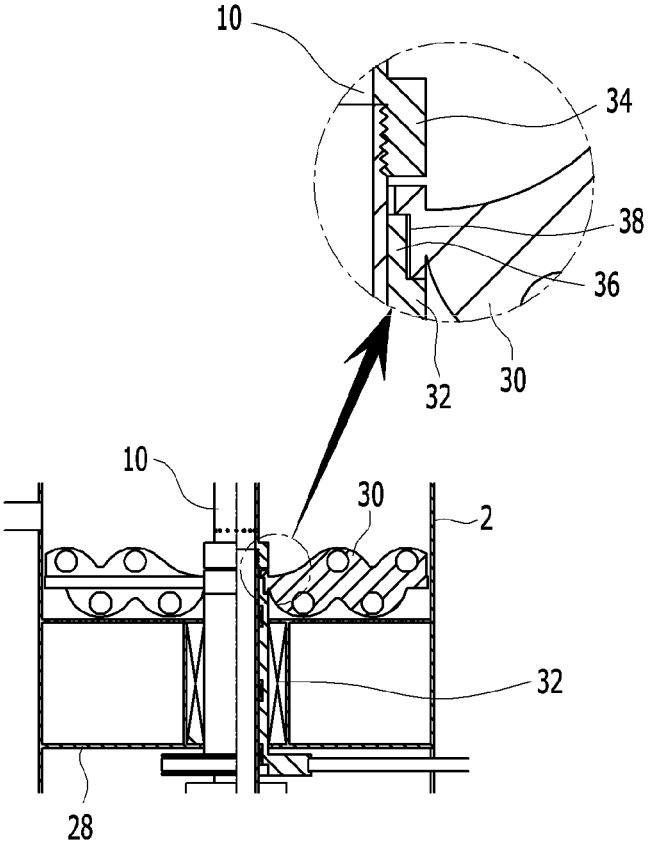
FIG. 4 is a partially enlarged cross-sectional view illustrating a structure that is related to a stirring rod of a lower portion of a combustion chamber of FIG. 1.
Figure 5:
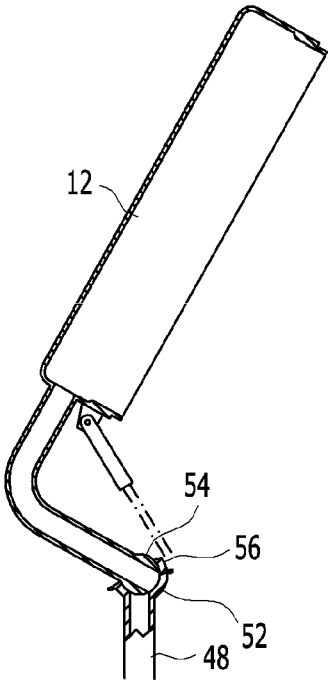
FIG. 5 is a partially enlarged cross-sectional view illustrating an automatic closing process of a ball valve according to opening of a lid of FIG. 1.
Figure 6:
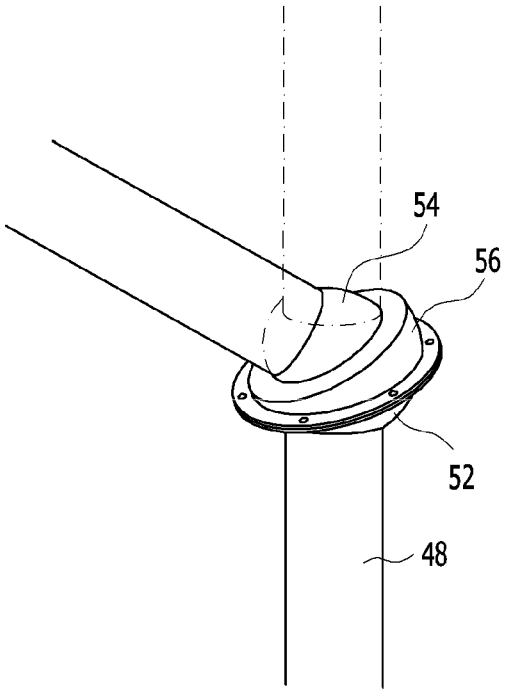
FIG. 6 is a partially enlarged perspective view illustrating a ball valve configuration of a circulation pipe of FIG. 1.
Figure 7:
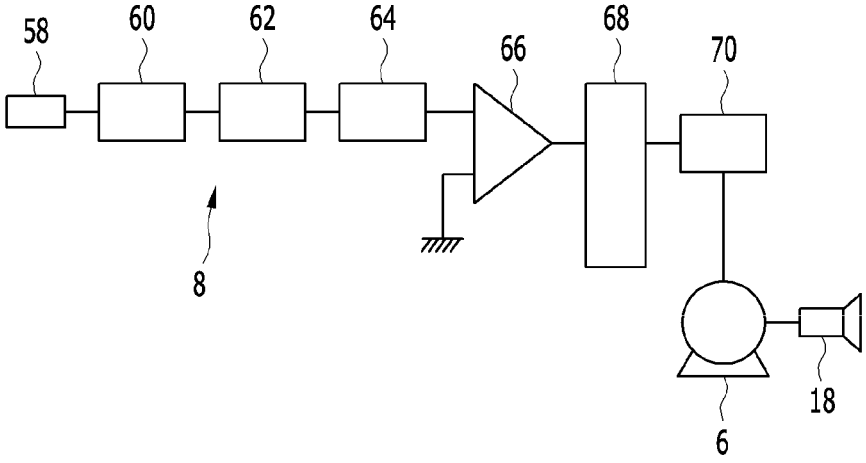
FIG. 7 is a block diagram illustrating a configuration example of a control circuit for constantly maintaining a temperature of a combustion chamber of a high-temperature pyrolysis incineration apparatus according to an exemplary embodiment of the present invention.

FIG. 1 is a side cross-sectional view of a high-temperature pyrolysis incineration apparatus according to an exemplary embodiment of the present invention, FIG. 2 is an enlarged view illustrating an air-supply tube that is disposed within a combustion chamber of FIG. 1 and a peripheral nozzle thereof, FIG. 3 is an exploded perspective view illustrating a coupling and mounting structure of a stopper of an upper end portion of an air-supply tube, FIG. 4 is a partially enlarged cross-sectional view illustrating a structure that is related to a stirring rod of a lower portion of a combustion chamber of FIG. 1, FIG. 5 is a partially enlarged cross-sectional view illustrating an automatic closing process of a ball valve according to opening of a lid of FIG. 1, FIG. 6 is a partially enlarged perspective view illustrating a ball valve configuration of a circulation pipe of FIG. 1, and FIG. 7 is a block diagram illustrating a configuration example of a control circuit for constantly maintaining a temperature of a combustion chamber of a high-temperature pyrolysis incineration apparatus according to an exemplary embodiment of the present invention.

As shown in FIG. 1, a high-temperature pyrolysis incineration apparatus according to an exemplary embodiment of the present invention includes a combustion chamber 2, a heat recovery device 4 and a fuel supply device 6 that are installed at a periphery thereof, and a controller 8.

It is preferable that internal and external surfaces of the combustion chamber 2 are produced with a steel sheet in which finishing processing is performed with a heat resistant and acid-resistant material at the center of the inside thereof, an air-supply tube 10 is vertically disposed, and in order to inject an incineration processing material, for example, general household waste or industrial waste into an upper portion, the upper portion thereof is covered to open and close with a lid 12, and at a periphery of an upper portion of the air-supply tube 10, fuel supply pipes 14 for promoting combustion are radially disposed.

It is preferable that the air-supply tube 10 is made of a material that can endure even at a high temperature of 1300° C. or more, and an oxygen inflow amount, a wind pressure, and an injection direction into the combustion chamber 2 are determined by a length and a cross-sectional shape thereof. As shown in FIG. 2, at a location that divides an external circumference thereof into a high portion, a middle portion, and a lower portion, a plurality of air-supply holes 16 are formed along an external circumferential surface, and thus the air-supply tube 10 may supply air to an entire region of a circumferential direction at a location of a high portion, a middle portion, and a lower portion of the combustion chamber 2. The air-supply hole 16 may be installed to have a size, a shape, a directional angle, a number, and a disposition gap that are accurately calculated in order to achieve an object of a high-temperature pyrolysis incineration apparatus according to an exemplary embodiment of the present invention.

Further, the fuel supply pipe 14 communicating with the fuel supply device 6 is extended along an inner circumferential surface of the combustion chamber 2 in an upper portion thereof, and in the fuel supply pipe 14, a plurality of fuel ejection nozzles 18 are arranged with an equal interval to supply fuel for combustion into the combustion chamber 2.

As a fuel to use in the present invention, waste oil or a liquefied oil fuel is appropriate.

By enabling an upper end portion of the air-supply tube 10 to be closed and sealed with a stopper 20 rather than being a permanently closed structure, the inside of the air-supply tube 10 may be cleaned. An opening and closing structure of the stopper 20 may adapt a screw fastening method, but in the present invention, as shown in FIG. 3, a one-touch structure is formed in which a coupling and mounting groove 21 and a cut-out portion 22 are formed at an inner circumferential surface of an upper end portion of the air-supply tube 10, and in which a latch 24 that enters through the cut-out portion 22 to engage with the coupling and mounting groove 21 and to be fastened to the coupling and mounting groove 21 is integrally formed in the stopper 20 to correspond thereto.

Referring again to FIG. 1, a lower end portion of the air-supply tube 10 communicates with a ventilation fan 26 that is installed at the outside of the combustion chamber 2, and in an upper portion of a punching plate 28 that defines the bottom of the combustion chamber 2, a stirring rod 30 is rotatably installed by a bearing portion 32 that supports a lower portion of the air-supply tube 10 with a fixing shaft.

It is preferable that the air-supply tube 10 and the stirring rod 30 are installed in a structure that can be disassembled, and in more detail, as shown in FIG. 4, a lower portion of the air-supply tube 10 is divided into a bottom portion of the combustion chamber 2 and an upper portion thereof, and the bottom portion and the upper portion are connected to be disassembled by a screw-type joint 34, an upper end portion of the bearing portion 32 is formed with a hexagonal convex portion 36, and in a nave of the stirring rod 30 corresponding thereto, a hexagonal recess portion 38 is formed and thus the bearing portion 32 and the stirring rod 30 are installed in a mutual fitting and combination structure.

In this way, when the air-supply tube 10 and the stirring rod 30 are installed in a structure that can be disassembled, components can be easily replaced upon being damaged, and disassembly and cleaning of components can be performed and thus a life-span of the apparatus can be extended.

As the stirring rod 30 has a plurality of holes therein, the stirring rod 30 may have a light weight, and as a contour of an upper portion and a lower portion thereof has a wave shape, an incineration processing material is evenly mixed instead of being cornered to one side and is spread to contact air while stirring, thereby being completely burned in a short time.

Because a pulley 40 is mounted in a lower side end portion that is extended to a lower portion of the punching plate 28, the bearing portion 32 rotates by a driving force that is transferred through a belt 42.

Referring again to FIG. 1, the belt 42 is connected to a driving motor 44 that is disposed at the outside of the combustion chamber 2 to rotate the stirring rod 30.

In an upper portion of the combustion chamber 2, at one side of the lid 12 that is opened and closed to a one-dot-chain line location of the drawings by a pneumatic pressure cylinder 46, a circulation pipe 48 is extended to be again connected to a lower portion of the combustion chamber 2 via the heat recovery device 4, and a feeding fan 50 and a ball valve 52 are installed in the circulation pipe 48 that is located between the lid 12 and the heat recovery device 4.

The feeding fan 50 forcibly transfers hot air of the combustion chamber 2 and promotes a circulation operation in which hot air that is injected through the circulation pipe 48 exchanges heat via the heat recovery device 4 and is returned again to a lower portion of the combustion chamber 2, thereby improving a heat recovery rate.

Further, the ball valve 52 automatically opens and closes the circulation pipe 48 by interlocking while opening and closing the lid 12, and when the lid 12 is opened, the ball valve 52 blocks the circulation pipe 48.

That is, as shown in FIG. 5, the ball valve 52 is attached to one side end of the circulation pipe 48 that is divided into two, and at the opposite side end thereof, a spherical valve body 54 is formed to be inserted into the ball valve 52, while a cap 56 is mounted thereon and is fastened with a rivet or a bolt and a nut and thus a connection state thereof is maintained.

When the circulation pipe 48 that is divided into two is put in a straight line shape, the ball valve 52 having such a configuration is in an open state, and when the pneumatic pressure cylinder 46 opens the lid 12, the ball valve 52 changes posture while being bent with a joint movement, thereby blocking the circulation pipe 48, as shown in FIG. 6.

In a high-temperature pyrolysis incineration apparatus according to an exemplary embodiment of the present invention having the foregoing configuration, a temperature sensor 58 for measuring a combustion state of the inside of the combustion chamber 2 may be provided, and by controlling the fuel supply device 6 with a value that is obtained by processing a measurement signal that is obtained by the temperature sensor 58 in the controller 8, an internal temperature of the combustion chamber 2 is maintained at 800° C. or more and thus dioxins may not occur upon combustion.

In an example of a circuit configuration of the controller 8 for processing a signal that is measured in the temperature sensor 58, as shown in FIG. 7, an amplifier 60 amplifies a measurement signal, the amplified signal is converted to a digital signal via a waveform shaping unit 62, and a signal that is counted and output in a counting unit 64 is input to a comparator 66. If the signal is larger than or equal to a reference level, when the signal is output and input to a calculation unit 68, the calculation unit 68 turns on a switching unit 70 to enable power to be applied to a fuel pump of the fuel supply device 6 and thus fuel is ejected from the nozzle 18 to promote internal combustion of the combustion chamber 2, thereby raising the temperature thereof.

In a high-temperature pyrolysis incineration apparatus according to an exemplary embodiment of the present invention having the foregoing configuration, by operating the pneumatic pressure cylinder 46, the lid 12 is opened and an incineration processing material is injected, and in a closed and sealing state in which the lid 12 is closed again, when forcibly transferring external air into the combustion chamber 2 by operating the ventilation fan 26, the outside air is ejected in a circumferential direction from the air-supply tube 10 of the center of the combustion chamber 2 through the air-supply hole 16 that is divided into a high portion, a middle portion, and a lower portion and is uniformly distributed to a corner of the inside of the combustion chamber 2.

In such a state, fuel that is supplied from the fuel supply device 6 is sprayed from the nozzle 18 via the fuel supply pipe 14, and when the inside of the combustion chamber 2 is simultaneously ignited, incineration is started.

While incinerating an incineration processing material, the ventilation fan 26 continuously transfers outside air, and fuel supply through the fuel supply pipe 14 is continued until an internal temperature of the combustion chamber 2 becomes 800° C. or more.

While incineration is started within the combustion chamber 2, the stirring rod 30 starts a rotation, stirs an injected incineration processing material, and enables the incineration processing material to be evenly exposed to fuel and air, thereby enabling the incineration processing material to be completely burned in a short time.

When an incineration processing material, particularly, an incineration processing material having a high moisture content, such as food, vegetable trash, an animal body, a diaper, and medical waste is processed, the incineration processing material is stacked at the bottom of the combustion chamber 2 by a self-load and thus when the internal incineration processing material is not burned, the stirring rod 30 mixes the incineration processing material to enable the internal unburned incineration processing material to be exposed to fuel and air and thus enables even an incineration processing material having a high moisture content to be completely burned in a short time.

By air that is ejected with the number, angle, and size that are respectively calculated through the air-supply hole 16 that is divided into a high portion, a middle portion, and a lower portion at an external circumference of the air-supply tube 10, at the inside of the combustion chamber 2, an air curtain is formed in three layers of a high portion, a middle portion, and a lower portion.

Because the air curtain of three layers suppresses divergence of heat occurring when incinerating an incineration processing material, a temperature of a combustion region rises to a high temperature of 1200° C. in a short time and thus the incineration processing material is clearly incinerated without incomplete combustion, and a vinyl or plastic product as well as an incineration processing material having a high moisture content is completely burned without occurrence of an exhaust gas.

Because incineration processing in a high-temperature pyrolysis incineration apparatus according to an exemplary embodiment of the present invention is performed in a high temperature atmosphere of about 1200° C., the high-temperature pyrolysis incineration apparatus is an environmentally-friendly incineration processing apparatus having no environment contamination that can originally block discharge of a harmful material and an exhaust gas, and because an incineration processing material is completely burned in a short time with incineration at a high temperature, a one-day processing capacity is remarkably increased, compared with an apparatus size, and thus the high-temperature pyrolysis incineration apparatus can be efficiently used.

When an internal temperature becomes 800° C. or more, heat that is generated in the combustion chamber 2 is recovered while representing a heat circulation operation of being supplied to the heat recovery device 4 through the circulation pipe 48 communicating with one side of the lid 12 and returning again to a lower portion of the combustion chamber 2, i.e., a waste heat is recovered.

In this process, when operating the feeding fan 50 that is installed in the circulation pipe 48, circulation of hot air within the combustion chamber 2 is promoted, and thus a waste heat recovery rate can be enhanced.

Further, because ash of an incineration processing material that is completely burned by the stirring rod 30 rotating at the bottom of the combustion chamber 2 is dropped and removed through the punching plate 28, an operator can continuously reinject and incinerate an incineration processing material without necessity to clean the combustion chamber 2 while operating.

In this case, when the lid 12 is opened by the pneumatic pressure cylinder 46, the ball valve 52 automatically blocks the circulation pipe 48 and hot air that is supplied to the heat recovery device 4 does not thus move backward to the inside of the lid 12, so when an incineration processing material is reinjected, the operator does not suffer burns by hot air.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The invention claimed is:

1. A high-temperature pyrolysis incineration apparatus comprising a combustion chamber that is isolated from the outside, the apparatus adapted to forcedly supply external air to the combustion chamber while burning at a high temperature within the combustion chamber an incineration processing material to be injected therein, the apparatus further comprising:

an air-supply tube that is fixedly disposed at the center of the combustion chamber;

a fuel supply pipe that is installed at an upper edge of the inside of the combustion chamber;

a punching plate that is disposed at the bottom of the combustion chamber to discharge ash that is generated by combustion to the outside;

a stirring rod that is rotatably installed at an upper surface of the punching plate using the air-supply tube as a fixing shaft;

a heat recovery device that is disposed at one side of the outside of the combustion chamber; and a circulation pipe that is extended from one side of a lid of the combustion chamber to the outside and that returns to a location corresponding to an upper portion of the stirring rod at a wall of the combustion chamber via the inside of the heat recovery device.

2. The high-temperature pyrolysis incineration apparatus of claim 1, wherein the stirring rod has a plurality of holes therein to have a light weight, and a contour of the upper and lower sides is formed in a wave shape, and at the inside of the combustion chamber, the stirring rod being adapted to stir the incineration processing material to uniformly contact air instead of being cornered to one side to be completely burned in a short time.

3. The high-temperature pyrolysis incineration apparatus of claim 1, wherein in the circulation pipe, a portion that is connected to the heat recovery device is divided into two, a ball valve is mounted at the circulation pipe of one side, and an end portion of the circulation pipe of the opposite side is formed in a spherical valve body to be combined in the ball valve and maintains a location by a cap that is fastened to the ball valve to automatically open and close the circulation pipe in synchronism with opening and closing of the lid.

4. The high-temperature pyrolysis incineration apparatus of claim 1, wherein a temperature sensor is disposed at the inside of the combustion chamber, and a controller comprises an amplifier that amplifies a measurement signal of the temperature sensor, a waveform shaping unit that converts the amplified signal to a digital signal, a counting unit that counts and outputs the waveform-shaped digital signal, a comparator that outputs a signal if an output signal of the counting unit is larger than or equal to a reference level, a calculation unit that outputs a signal when a signal of the comparator is input, and a switching unit that is turned on to drive a fuel pump of the fuel supply device when a signal of the calculation unit is applied.

* * * * *